343-700 MS AU 256 EX
11/24/81 XR 4,302,746

United States Patent [19]

Scarzello et al.

[11] 4,302,746

[45] Nov. 24, 1981

[54] SELF-POWERED VEHICLE DETECTION SYSTEM

[75] Inventors: John F. Scarzello, Columbia; Daniel S. Lenko, Silver Spring; Albert D. Krall, Rockville; Wayne R. Grine, Crownsville; Robert E. Brown, Silver Spring; George W. Usher, Wheaton, all of Md.; Milton K. Mills, Washington, D.C.; Albert M. Syeles, Silver Spring, Md.

[73] Assignee: The United States of America as represented by the Secretary of the Navy, Washington, D.C.

[21] Appl. No.: 117,708

[22] Filed: Feb. 1, 1980

[51] Int. Cl.[3] ..... G08G 1/01; H01Q 1/36

[52] U.S. Cl. ..... 340/38 L; 324/247; 340/38 R; 343/700 MS; 343/895

[58] Field of Search ..... 340/38 R, 38 L, 551, 340/552, 539, 41 R, 40, 663, 636; 235/92 TC; 364/551, 424, 436, 443, 460; 324/236, 244, 247, 260; 343/700 MS, 895, 846, 829, 830; 246/125, 28 R, 29 R; 455/42, 66, 67, 110, 31, 35, 36, 150, 227

[56] References Cited

U.S. PATENT DOCUMENTS

| | | | |
|---|---|---|---|
| 3,758,775 | 9/1973 | Hopkins | 340/38 L |
| 3,984,764 | 10/1976 | Koerner | 340/38 L |
| 3,989,932 | 11/1976 | Koerner | 340/38 L |
| 4,179,744 | 12/1979 | Lowe | 340/38 L |

*Primary Examiner*—James J. Groody
*Attorney, Agent, or Firm*—R. S. Sciascia; A. L. Branning; D. A. Lashmit

[57] ABSTRACT

An improved self-powered vehicle detector (SPVD) uses a two-axis magnetometer to sense a vehicle's magnetic signature and then telemeter vehicle presence information to a roadside receiver. The SPVD system includes digital nulling loops to cancel D.C. offset changes in the magnetometic output, a multi-tone code transmitter to transmit vehicle presence and SPVD condition signal, and an omnidirectional microstrip antenna to simplify installation and maintenance of the SPVD.

15 Claims, 9 Drawing Figures

SELF-POWERED VEHICLE DETECTION SYSTEM

BACKGROUND OF THE INVENTION

The present invention relates to roadway vehicle detection systems and more particularly to a self-powered vehicle detector coupled by an RF link to a remotely located traffic control device.

Vehicle detectors are key components in all street and freeway traffic control and surveillance systems. An ideal detector for these applications should meet such requirements as low cost, accurate detection, minimum installation time and cost, reliability under all environmental conditions, low maintenannce and calibration requirements, and ability to detect all vehicles on any standard roadway surface.

Prior vehicle detection systems typically include an inductive loop or coil of wire buried in the pavement and coupled to electronic sensing circuits controlled by changes in the loop inductance when a vehicle passes thereover. A hardwired or transmitter/receiver link couples the detector signal to a traffic control device. Inductance loop systems require considerable time and cost for installation and removal, and many self-powered systems have a limited operational life due to a relatively high power consumption. Another vehicle detection problem arises when a vehicle is stopped over a detector for an extended period of time, which could disable prior systems until the vehicle is removed.

SUMMARY OF THE INVENTION

Accordingly, the present invention overcomes many of the shortcomings of prior systems by providing a self-powered vehicle detection system that detects the presence of a vehicle by measuring its magnetic field beneath the roadway surface. A radio frequency telemetry transmitter conveys the vehicle presence and SPVD status information to a roadside control unit, which may be interfaced to other traffic control devices. An omnidirectional microstrip antenna (OMA) integral with the SPVD housing reduces installation and maintenance problems by permitting the SPVD to be implanted in a small bore hole.

An SPVD unit containing a magnetic sensor module, a transmitter/encoder module and an OMA is implanted in the center of a traffic lane. When a vehicle passes over the SPVD, it transmits coded leading and trailing edge pulses which are received and decoded by a remotely located control unit. The vehicle presence detection time is set to a preselected time delay, after which the sensor module rezeroes digital nulling loops included therein and again becomes active, thus alleviating the problem of vehicles stalled over the detector.

OBJECTS OF THE INVENTION

It is therefore an object of the invention to provide an improved self-powered vehicle detector having low power consumption which may be easily installed and removed from a roadway surface.

Another object of the present invention is to provide an accurate SPVD including a magnetometer and digital nulling to cancel D.C. offset changes in the magnetometer output.

Still another object of the present invention is to provide as SPVD system that overcomes the problem of a vehicle stalled over the detector.

Yet another object of the present invention is to provide an SPVD system having a tone coded RF link and an omnidirectional microstrip antenna.

BRIEF DESCRIPTION OF THE DRAWINGS

Other objects and many of the attendant advantages of this invention will be readily appreciated as the same becomes better understood by reference to the following detailed description when considered in conjunction with the accompanying drawings, in which like reference numerals designate like parts, and wherein.

DESCRIPTION OF THE PREFERRED EMBODIMENT

SYSTEM DESCRIPTION

The present vehicle detection system has two main components, an SPVD located in a roadway and a control unit located, for example, in a weatherproof traffic instrumentation enclosure. The battery-powered SPVD is typically implanted approximately one inch below the roadway surface and requires no external connections.

Figure 1:
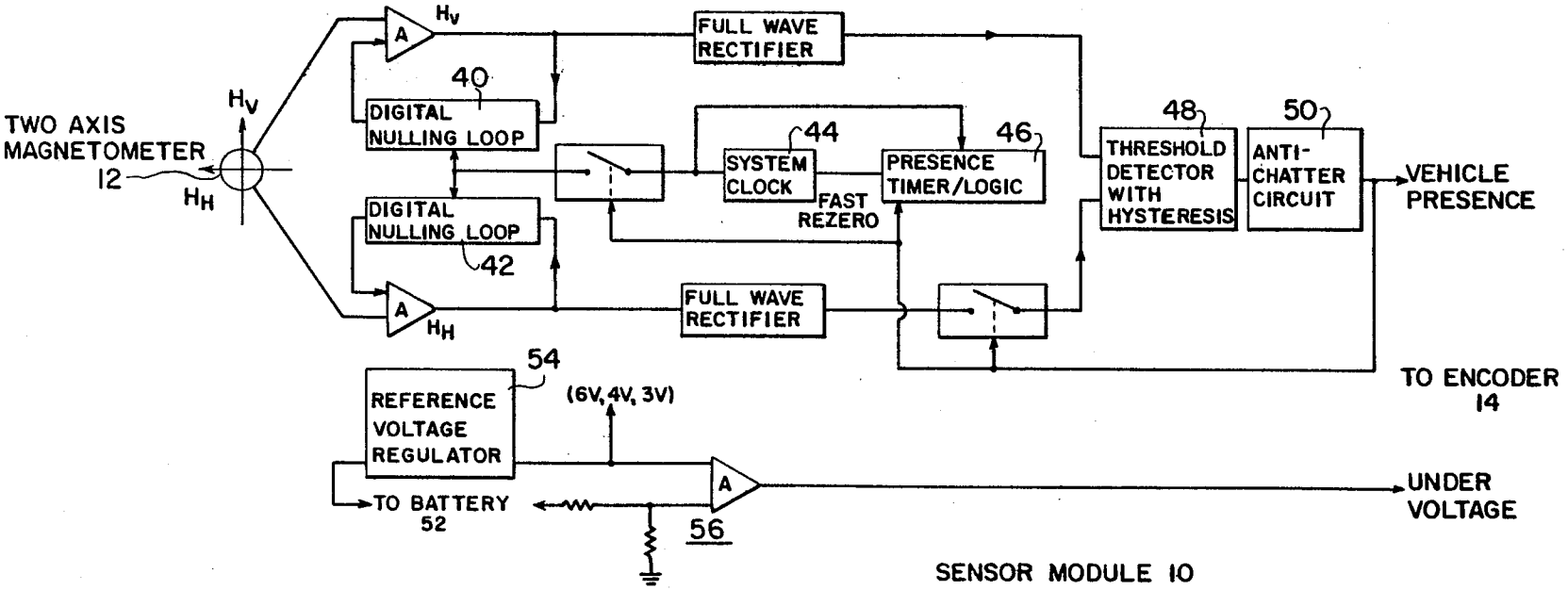
FIG. 1 is a block diagram of a self-powered vehicle detector (SPVD) magnetic sensor module according to the present invention.
Figure 2:
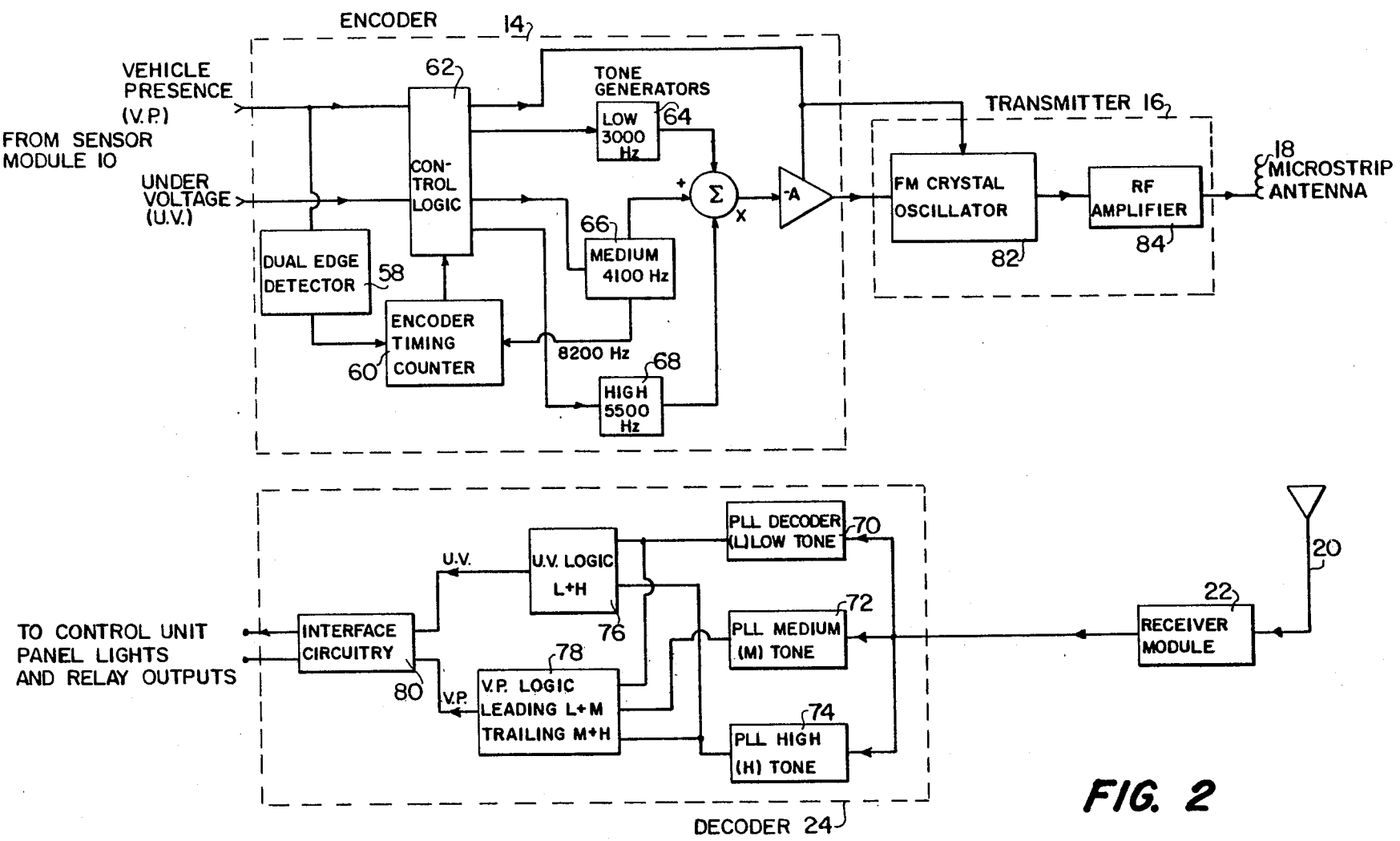
FIG. 2 is a block diagram of an encoder, transmitter/-receiver link and decoder used in the SPVD system.

Referring now to the drawings, FIGS. 1 and 2 show the SPVD system in block diagram form. The SPVD includes a magnetic sensor module 10 which, when a vehicle is detected by a two-axis magnetometer 12, generates a leading edge pulse and a trailing edge pulse indicating the arrival and departure, respectively, of a vehicle. Sensor module 10 also includes circuitry for generating an undervoltage signal when its battery voltage reaches a predetermined low level. The signals from sensor module 10 are coupled to a tone encoder 14 that generates three distinct combinations of two tones each responsive to the vehicle presence and undervoltage pulses from sensor module 10. Encoder 14 is coupled to and modulates a radio frequency (RF) transmitter 16, which is in turn coupled to a quarter wavelength omnidirectional microstrip antenna OMA 18 incorporated into the housing of the SPVD. OMA 18, which replaces the transmitting loop antenna in prior systems, greatly simplifies the installation and maintenance of the SPVD.

The RF signal from the SPVD is received by a standard quarter wavelength whip antenna 20 at a remotely located control unit, which houses a receiver module 22 that demodulates, amplifies and filters the SPVD signal. A tone decoder 24 determines which combination of tones are present in the receiver 22 audio output signal and enables the appropriate interface circuitry based upon whether a vehicle presence is sensed and if an undervoltage signal is detected.

Figure 3:
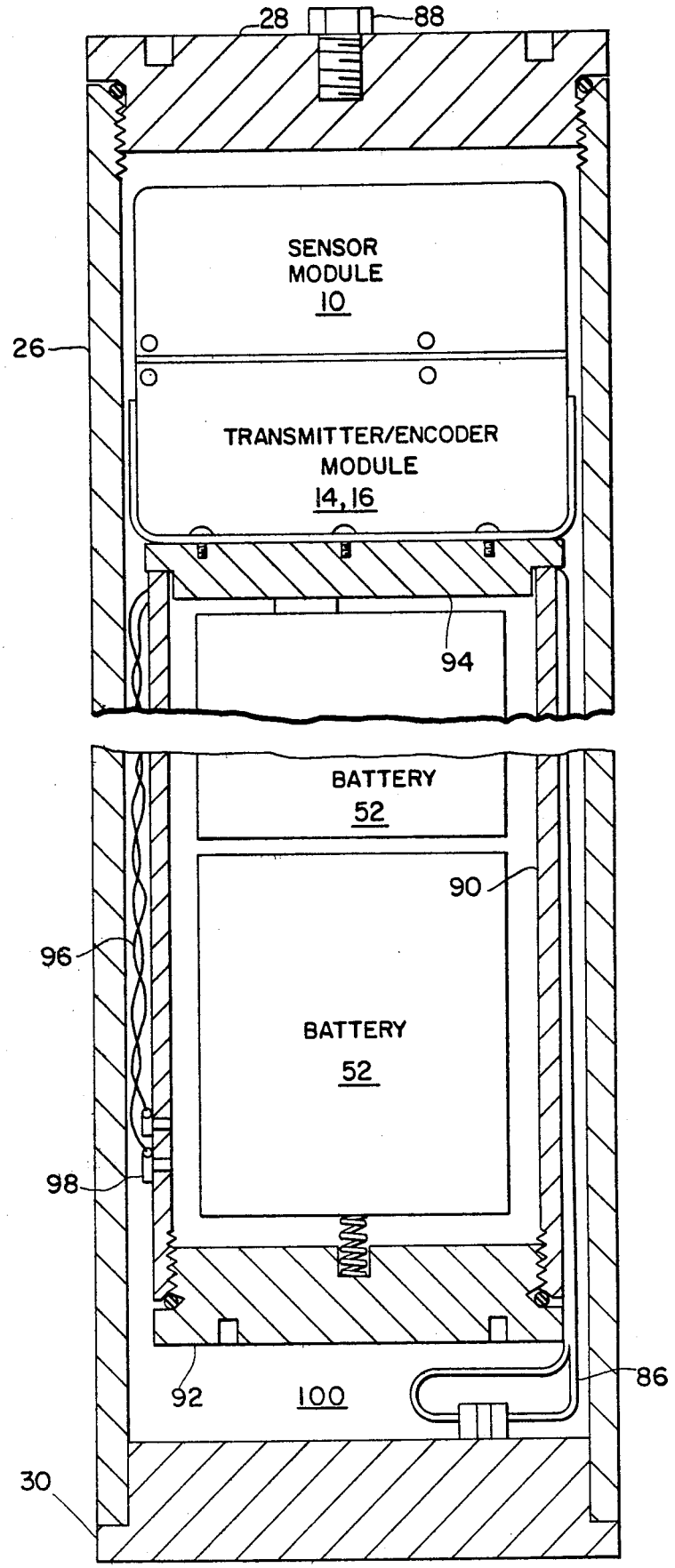
FIG. 3 is a cutaway of the SPVD housing showing the component parts thereof.

Referring to FIG. 3, the SPVD is contained in a cylindrical, weatherproof housing 26 formed, for example, of fiberglass or PVC. Housing 26 is sealed by end caps 28 and 30, with top end cap 28 being removable for assembly and maintenance of the SPVD. In order that a more complete understanding of the structure and operation of the SPVD system might be obtained, the individual components thereof are described in detail below.

MAGNETOMETER

Magnetometer 12 may advantageously be a ring-core fluxgate magnetometer that measures both vertical and horizontal vehicle signal components. Fluxgate magnetometers in general require that electrical current be supplied periodically to a winding to magnetically saturate one or more magnetic cores. The presence of an applied magnetic field such as the earth's field or the field of a magnetic body like a motorized vehicle is detected by an extra signal produced on the core windings as the magnetic material of the core cycles in and out of saturation and exhibits non-liner permeability. A certain energy must be supplied in each cycle to bring about saturation of the magnetic material. For the magnetometer to have minimum power consumption, it is important to select an appropriate magnetic core and to optimize drive circuitry efficiency and stability. The magnetic element of magnetometer 12 may advantageously be formed of a Moly-Permalloy core, which yields a useful range of sensitivity-noise-power consumpter combinations.

Various magnetometer and gradiometer structures are shown, for example, in U.S. Pat. Nos. 3,649,908 to Brown, 3,448,376 and 3,449,665 to Geyger, and 4,059,796 to Rhodes. Detection of the ambient magnetic field-dependent signal is performed with windings on a ring-core coupled to, for example, a balanced pulse averaging difference detector. The outputs from the balanced detectors are the vertical and horizontal magnetic field signals, $H_V$ and $H_H$, which are coupled to and processed by sensor module 10.

SENSOR MODULE

Referring again to FIG. 1, the functions of sensor module 10 are to amplify the magnetometer output signals, null out the DC offset changes in the magnetometer caused by time and temperature, perform vehicle presence timing and logic functions, compare the magnetic field components to predetermined thresholds, and discriminate against sudden short RFI/EMI bursts to lower the SPVD false alarm rate.

Since the magnetometer output voltage is linearly related to the measured ambient magnetic field, in most cases there will be a DC offset in both the horizontal and the vertical axes. The capability of the SPVD to respond to a long vehicle presence time requires that the magnetometer be DC coupled so that a vehicle's magnetic signature will not be changed by the sensor-/amplifier coupling over an extended vehicle presence period. The required compensation is provided by a pair of digital nulling loops DNL 40 and DNL 42 coupled to the vertical and horizontal magnetic signals, respectively. Basically each DNL is a digital-to-analog converter which senses the magnetometer signal amplified output and, if outside specific limits, develops an appropriate reverse polarity nulling voltage which is coupled to the amplifier's non-inverting input. A low frequency system clock 44 provides short duration pulses to activate the DNLs and to eliminate any residual offset buildup which could occur for a constant stream of vehicles passing over the SPVD. The nulling loops will attempt to compensate for any change in DC signal level until a predetermined threshold is reached, at which time the clock 44 pulses will be inhibited to the DNLs and coupled to a presence timer circuit 46 that counts the number of clock pulses until a preset vehicle presence time is reached. Timer 46 then couples a FAST REZERO signal to the system clock 44 for a fast DNL rezero, and the SPVD again becomes active. If a vehicle leaves prior to the preset time, the DNL clock pulses are restored and they resume their slow nulling of any ambient magnetic field or sensor changes with time and temperature.

A hysteresis threshold detector 48 activates an anti-chatter circuit signal 50 which discriminates between real vehicle detection signals and short, high amplitude pulses associated with RFI/EMI.

A 6 volt (nominal) high amp-hour capacity battery 52 powers the SPVD. A mercury battery has been found to provide long and reliable operating lifetimes, although other battery types or a solar cell supply are also compatible with the present SPVD. Sensor module 10 is isolated from battery 52 by a diode and RC filter to enhance transient immunity and to minimize any surges and drops in system voltage resulting from transmitter activation. A self-starting low power voltage regulator 54 provides the reference voltage for magnetometer 12 as well as the required voltage for the other system components, and an undervoltage sensor 56 provides an output to encoder 14 when the system voltage is, for example, 20% less than normal.

The complete sensor module may be housed in an aluminum container with EMI filters on the 6 volt, vehicle presence, and undervoltage outputs. This, along with isolated circuit board mounting provides thermal inertia for the magnetometer and thereby eliminates rapid changes in sensor characteristics due to temperature variations.

ENCODER

As described above, sensor module 10 generates three information items for use by the roadside control unit. These are the leading edge occurrence of the vehicle presence (V.P.) signal indicating the arrival of a vehicle, the trailing edge of the V.P. signal indicating the departure of the vehicle, and the existence of an undervoltage (U.V.) condition of the SPVD battery. Each of the above signals is converted by encoder 14 to two simultaneous tones which are added together for transmission lasting approximately 30 ms., the short transmission time being required to prolong the operational lifetime of the SPVD. Although various tone combinations are compatible with the present system, the following encoder tones are given for purposes of illustration.

| Tone Combination | Information |
|---|---|
| 3000 Hz., 4100 Hz. | V.P. Leading Edge |
| 4100 Hz., 5500 Hz. | V.P. Trailing Edge |
| 3000 Hz., 5500 Hz. | Trailing Edge/undervoltage |

Figure 6:
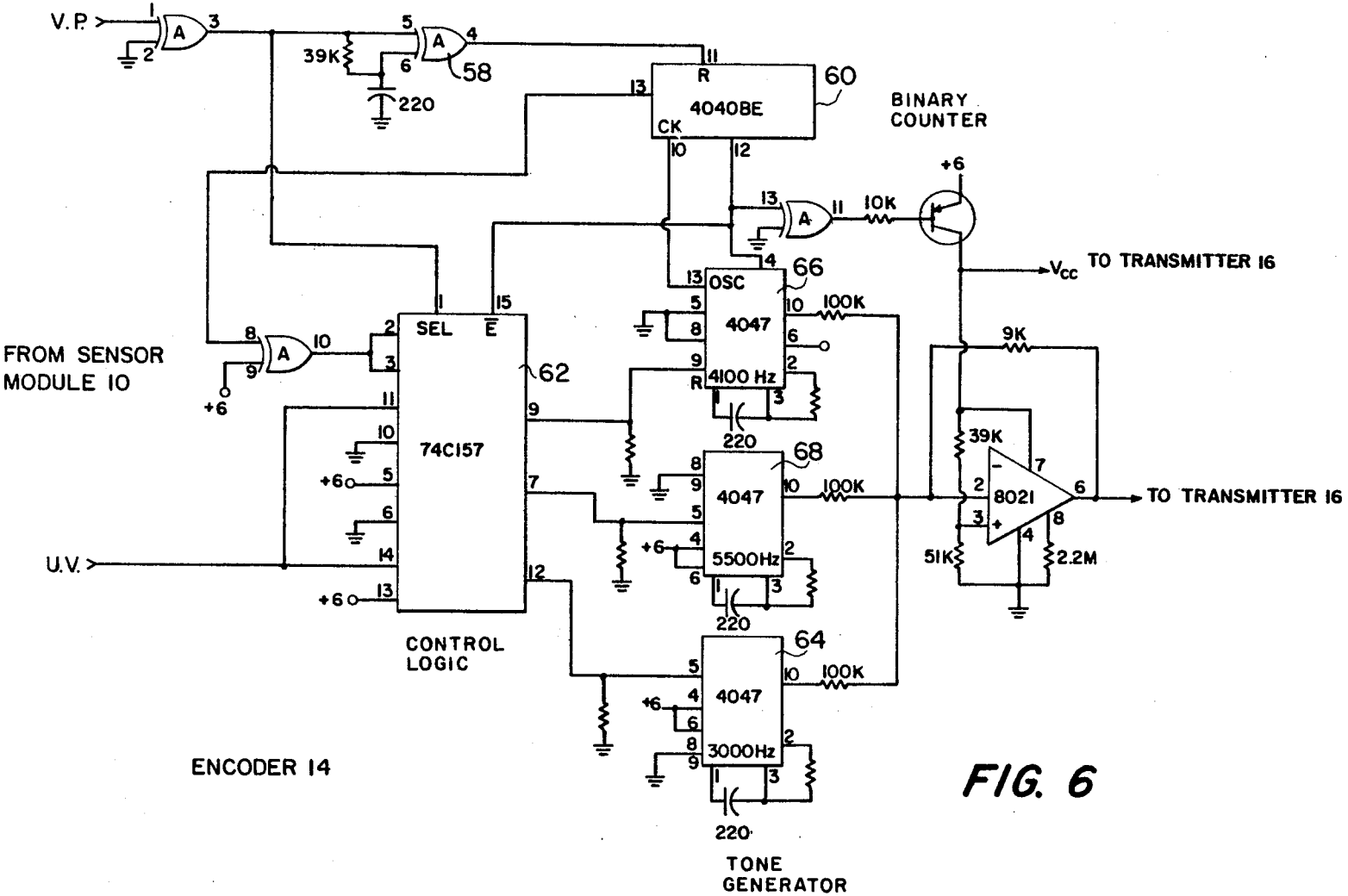
FIG. 6 is a schematic diagram of the encoder of FIG. 2.

Referring to FIGS. 2 and 6, a dual edge detector 58 senses the leading edge or the trailing edge of the vehicle presence signal, and a 12 stage binary counter 60 times the 30 ms. transmit pulse. The particular combination of tones is determined by control logic 62 which is a quad 2:1 multiplexer with strobe used as an 8×3 ROM. A suitable multiplexer is a 74C157 or similar CMOS integrated circuit. Control logic 62 is coupled to three tone generators 64, 66 and 68 which generate the low, medium and high tones, respectively. The selected tones are summed, amplified and coupled to transmitter 16. Counter 60 is driven by a 2X output of tone generator 66 to provide an 8200 Hz clock signal. When a V.P. signal is present, dual edge detector 58 emits a pulse which clears counter 60 and allows generator 66 to pulse counter 60 at a rate of 8200 Hz. When 256 pulses (31 ms.) have been counted generator 66 is inhibited and the circuit is again in an inactive state. As the vehicle departs, the V.P. signal goes low causing detector 58 to output another pulse resulting in another 31 ms. pulse from control logic 62.

DECODER

Once the encoded information transmitted from the SPVD is demodulated by receiver 22, the signal is coupled to low pass and high pass filters to reduce out-of-band noise and then amplified to achieve a sufficient signal level before entering decoder 24.

Figure 8:
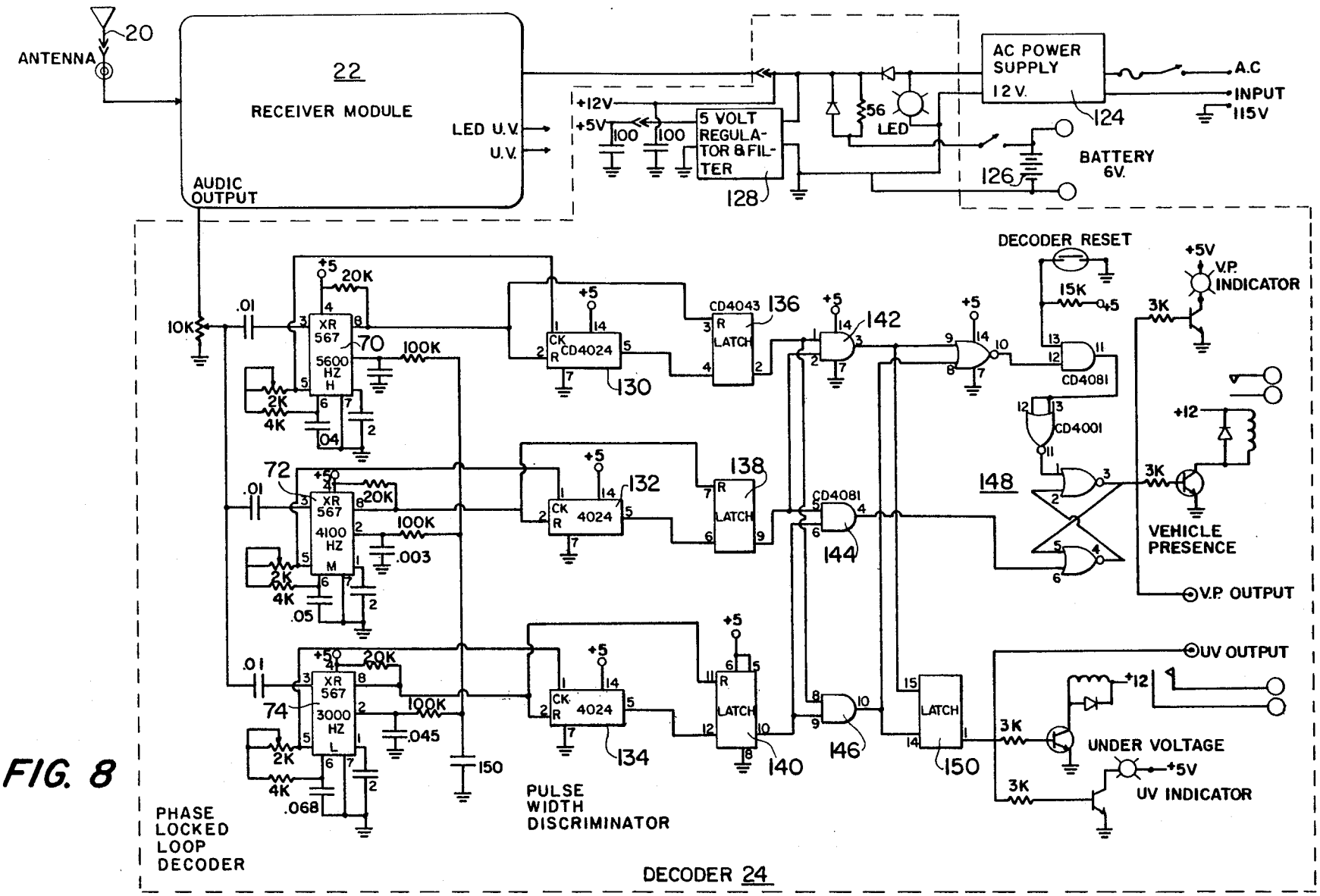
FIG. 8 is a schematic diagram of the decoder of FIG. 2.

Referring now to FIGS. 2 and 8, decoder 24 is formed of three phase-locked-loop tone decoders PLL 70, 72 and 74, each of which is set to recognize one of the three tones generated by encoder 14. An undervoltage logic circuit 76 and a vehicle presence logic circuit 78 coupled to the PLL outputs determine what information is contained in the SPVD signal. The resulting U.V. and V.P. signals are coupled to interface circuitry 80 such as indicators and relays which in turn control the traffic signal or counter systems. The decoder circuit and operation will be described in greater detail below.

RF Telemetry Link

Referring now to FIG. 2, the RF telemetry link comprises transmitter 16, OMA 18, antenna 20 and receiver module 22.

Figure 7:
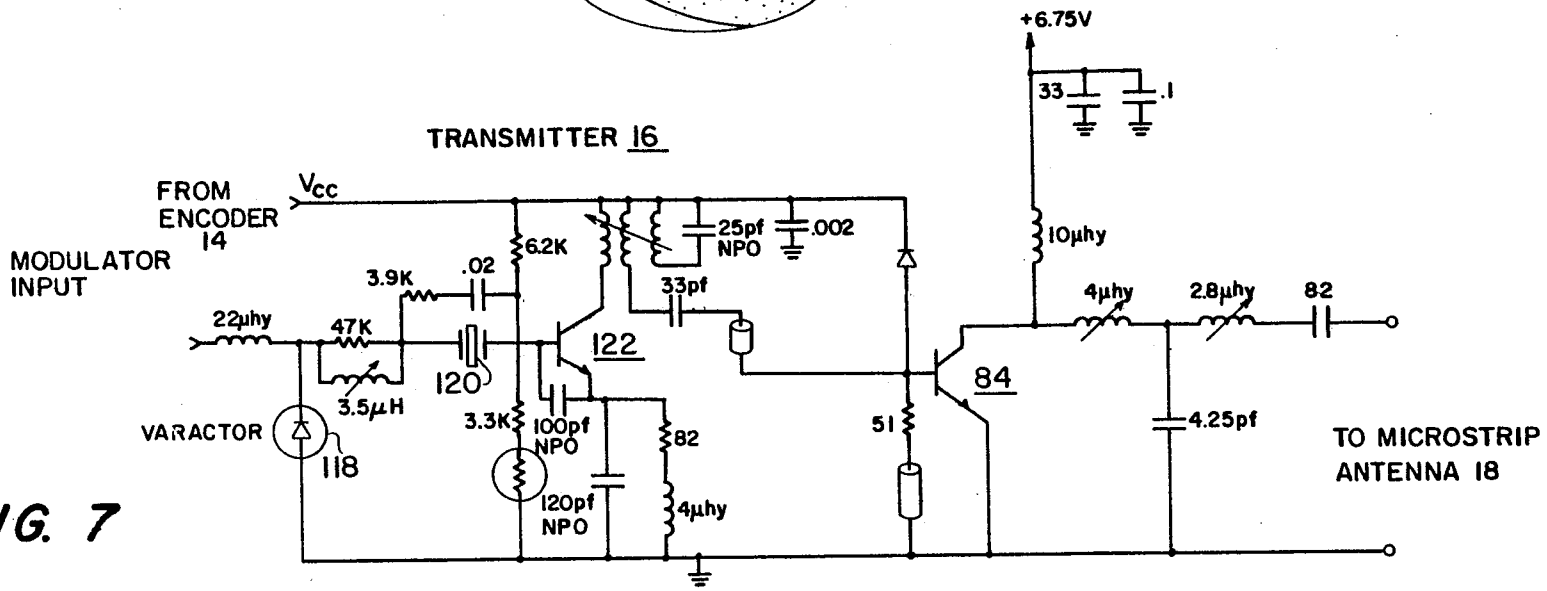
FIG. 7 is a schematic diagram of the transmitter of FIG. 2.

Referring to FIGS. 2 and 7 transmitter 16 includes a direct frequency modulation, voltage controlled crystal oscillator 82 incorporating a varactor diode as the reactance modulator, as shown in FIG. 2. An RF amplifier 84 coupled to oscillator 82 provides approximately 100 mW. of RF power to OMA 18.

Receiver module 22 includes a narrow band FM system having a modulation index less than approximately 1.6. Various commercially available double conversion scanner type receivers are suitable for use in the present system. It has been determined, for reliability and adequate system performance, that the RF telemetry system should operate at approximately 40 MHz. with a modulation bandwidth of approximately ±10 KHz. Receiver 22 should have a sensitivity of approximately 0.4 μv. for a 12 db. SINAD, and an image rejection and intermodulation performance of greater than approximately 85 db. and 65 db., respectively.

Figure 4:
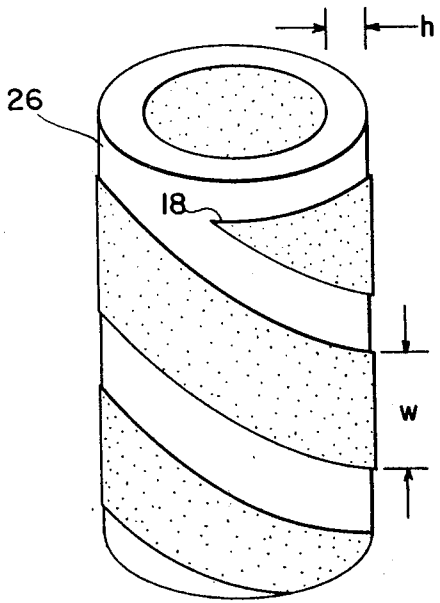
FIG. 4 is a pictorial view of one embodiment of an omnidirectional microstrip antenna used in the SPVD.

Referring now to FIG. 4, OMA 18 is effectively a quarter wavelength shorted microstrip transmission line spiraled around a cylinder, in this case the housing 26 of the SPVD. The structure of OMA 18 is set forth in a copending U.S. patent application entitled "Omnidirectional Microstrip Antenna," serial number 80,596, filed on Oct. 1, 1979, and assigned to the assignee of the present invention. For a 41 MHz. operating frequency, it has been found that a copper antenna configured as shown in FIG. 4 having a length of approximately 1.24 meters (48.7"), a gap of h=0.03 m. (1.3"), and a width w=0.064 m. (2.5") yields an omnidirectional radiation pattern having vertical polarization. Referring to FIG. 3, OMA 18 would be affixed to the outer surface of housing 26, while a ground plane would be placed on the inner surface of the housing. OMA 18 is protected, for example, by coatings of an acrylic laquer primer followed by a polyurethane clear enamel. Transmitter 16 is coupled to OMA 18 by means of a coaxial cable 86.

HOUSING

As described above, referring to FIG. 3, the SPVD is contained in a cylindrical housing 26 sealed at one end by an end cap 30 and at the other end by a removable threaded end cap 28. The SPVD is vertically implanted with end cap 30 down, and a nylon screw 88 is provided for removal of the SPVD, should it be necessary. The battery 52 power supply is enclosed in a cylindrical housing 90 spaced within housing 26 and sealed by end caps 92 and 94, with cap 92 being threaded for removal. A pair of conductors 96 couples batteries 52 to sensor module 10, with fusible links 98 disposed therebetween. During assembly of the SPVD, foam spacers (not shown) are placed in the space 100 between battery housing end cap 92 and SPVD housing end cap 30 to provide a shock-proof and stable structure.

CIRCUIT DESCRIPTION

Figure 5A:
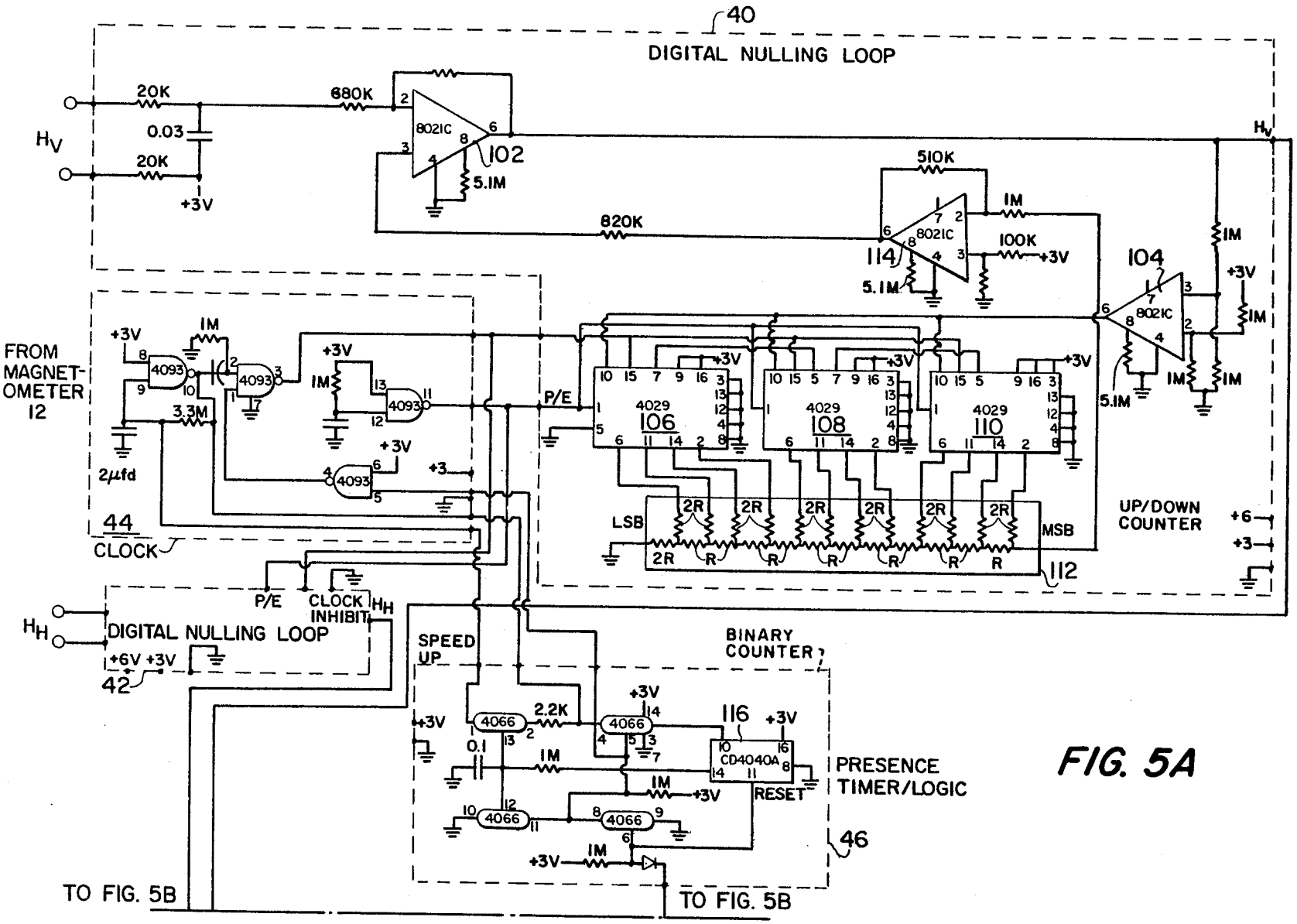
FIGS. 5*a* and 5*b* are schematic diagrams of the magnetic sensor module of FIG. 1.
Figure 5B:
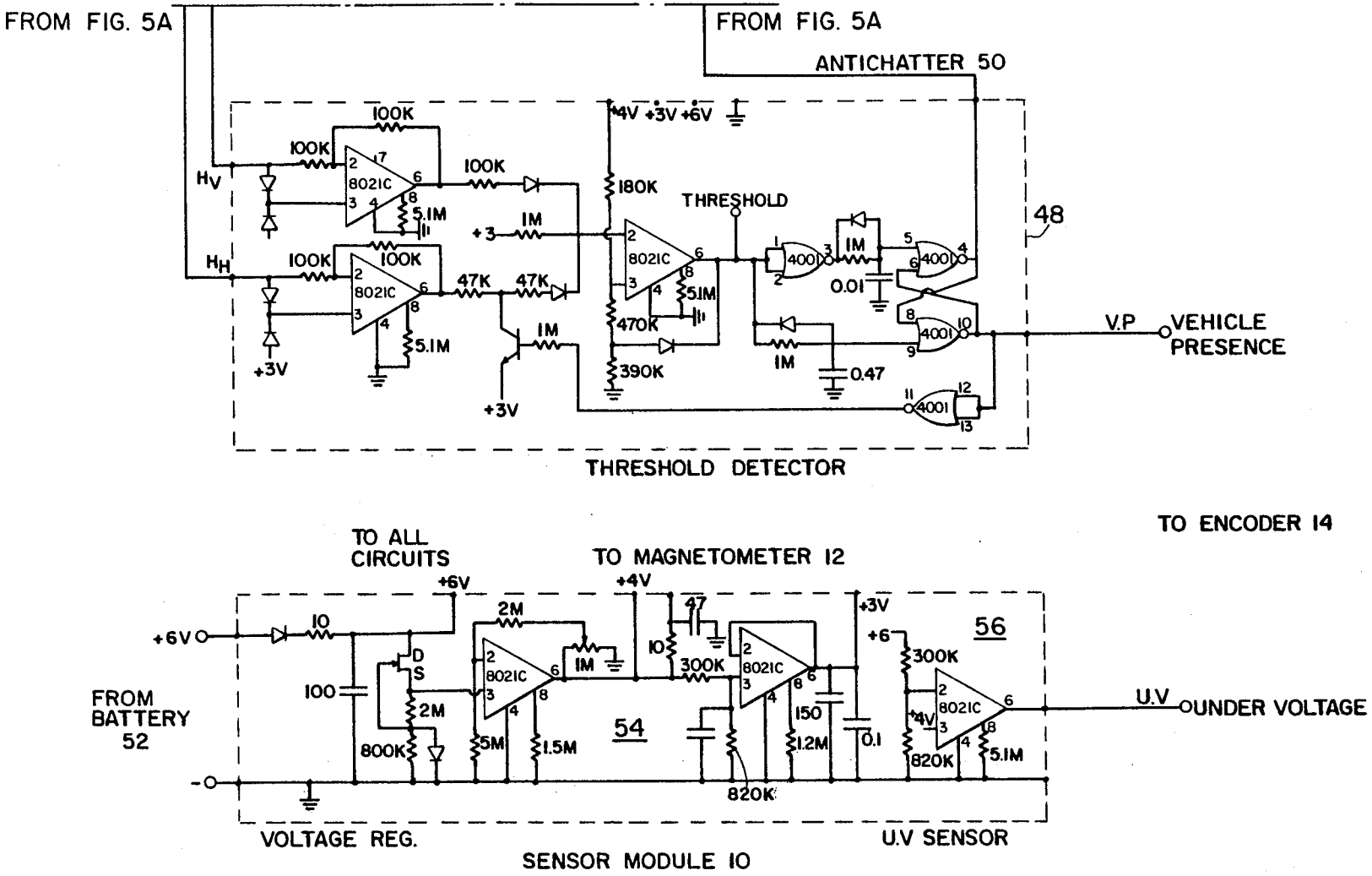

Referring now to FIGS. 5*a* and 5*b*, there is shown in schematic diagram form one embodiment of the sensor module of FIG. 1. As DNL 40 and DNL 42 are identical in structure and operation, only DNL 40 will be described. The vertical component signal $H_V$ from magnetometer 12 is coupled to the non-inverting input of an amplifier 102, the output of which is coupled to the input of a comparator 104. Comparator 104 is coupled to three up/down counters 106, 108 and 110 which are in turn coupled to a 12 bit R-2R resistive ladder network 112, where R=50K. Network 112 produces an analog output voltage which is scaled by an amplifier 114 and coupled to the inverting input of amplifier 102. If, for example, the amplified signal from amplifier 102 is positive, comparator 104 causes counters 106–110 to count down and provide a positive nulling voltage from network 112. This causes DNL 40 to compensate for relatively slow changes in the ambient magnetic field as detected by magnetometer 12. System clock 44 provides low frequency pulses to counters 106–110 to eliminate any residual offset buildup. If the $H_V$ signal reaches a preset threshold level, clock 44 is inhibited to counters 106–110 and instead is coupled to a binary counter 116 in presence timer 46. When a predetermined time has elapsed, timer 46 sends a "speed up" signal to clock 44 that causes a fast DNL rezero, and the system becomes active again.

The $H_V$ and $H_H$ outputs from DNL 40 and DNL 42 are coupled to threshold detector 48 where they are rectified and compared to a preset level, for example 3000 nT, above which a vehicle presence signal is generated.

The V.P. signal from sensor module 10 is coupled to encoder 14, which as described above, generates a combination of two out of three possible tones which are in turn coupled to RF transmitter 16. Referring to FIG. 7, FM crystal oscillator 82 uses a varactor 118 as a reactance modulator. A crystal 120 having a frequency of approximately 20 MHz. is coupled to an oscillator/doubler 122 to achieve an unmodulated system frequency of approximately 40 MHz. The output of oscillator/doubler 122 is coupled to RF amplifier 84 which is adjusted for an output of 100 mW.

The encoded RF signal is radiated by OMA 18, received by antenna 20, and demodulated, filtered and amplified by receiver module 22. FIG. 8 shows in schematic diagram form the system components enclosed within the roadside control unit located remote from the SPVD. Under normal conditions power to the control unit is supplied by an AC power supply 124, with backup power from a 6 volt battery 126 coupled to a voltage regulator 128.

As described above, the audio output signal from receiver 22 is coupled to and decoded by phase-locked-loops PLL 70, 72 and 74. The PLL outputs go low whenever the incoming signal contains sufficient spectral energy that is within their detection bands. The outputs of the PLLs are coupled to pulse width discriminators 130, 132 and 134 to provide additional noise immunity, the outputs thereof being coupled in turn to latches 136, 138 and 140, respectively, which store a valid tone reception until the PLLs lose their lock on the tones. Latches 136–140 control decoding logic which determines what information was transmitted by the SPVD. The decoding logic is formed of three AND gates 142, 144, 146, a vehicle presence flip-flop circuit F-F 148, and an undervoltage flip-flop circuit F-F 150. The outputs of F-F 148 and F-F 150 drive transistor inverting buffers which enable LED indicators and relays, which may be coupled to traffic control or surveillance circuits.

Thus, there has been provided by the present invention an improved self-contained vehicle detector which overcomes many of the disadvantages of prior vehicle detectors by using a low power magnetometer and an RF telemetry link including an omnidirectional microstrip antenna.

Obviously, many modifications and variations of the present invention are possible in light of the above teachings. It is therefore to be understood that within the scope of the appended claims the invention may be practiced otherwise than as specifically described herein.

What is claimed and desired to be secured by Letters Patent of the United States is:

1. A vehicle detection system comprising:

a two-axis magnetometer for generating signals proportional to the vertical and horizontal magnetic field components at a desired monitoring location;

means coupled to said magnetometer for nulling said vertical and horizontal magnetic field signals whenever said signals are below a predetermined threshold level, wherein said nulling means generates a vehicle presence pulse whenever said vertical and horizontal magnetic field signals exceed said threshold level;

encoder means coupled to said nulling means for generating a first multi-tone signal upon the occurence of the leading edge of said vehicle presence pulse and a second multi-tone signal upon the occurence of the trailing edge of said vehicle presence pulse;

transmitter means coupled to said encoder means for generating a radio frequency signal proportional to said multi-tone signals;

first antenna means coupled to said transmitter means for radiating said radio frequency signal as a vertically polarized wave;

second antenna means spaced apart from said first antenna means for receiving said vertically polarized wave;

receiver means coupled to said second antenna means for detecting and demodulating said radio frequency signal; and decoder means coupled to said receiver means for providing a control signal upon receipt of said multitone signals.

2. The vehicle detection system of claim 1 wherein said magnetometer, said nulling means, said encoder means, said transmitter means and said first antenna means are enclosed within a nonmagnetic, corrosion resistant, substantially cylindrical housing sealed by end caps, said housing further enclosing a battery for supplying power to said vehicle detector system.

3. The vehicle detection system of claim 2 wherein said first antenna means comprises:

an omnidirectional antenna formed of a radiating transmission line spiraled about the outer surface of said cylindrical housing, said antenna being configured to radiate at the frequency of said transmitter means.

4. The vehicle detection system of claim 3 wherein said nulling means comprises:

a pair of digital nulling circuits respectively coupled to receive said vertical and horizontal magnetic field signals, wherein each of said nulling circuits comprises:

an amplifier having inverting and non-inverting inputs and an output, wherein said non-inverting input is coupled to the respective magnetic field signal;

digital-to-analog converter means coupled to the output of said amplifier for generating an analog voltage proportional to said magnetic field signal, wherein said analog voltage is coupled to the inverting input of said amplifier, thereby nulling said amplifier output; and clock means coupled to said digital-to-analog converter means for enabling said converter means at predetermined time intervals, thereby allowing said digital nulling circuit to cancel said magnetic field signal for slow changes in the levels thereof;

threshold detector means coupled to each of said digital nulling circuits for generating a vehicle presence pulse whenever said magnetic field signals exceed a predetermined level, wherein the output for said threshold detector means is coupled to said encoder means.

5. The vehicle detection system of claim 4, further including:

presence timer means coupled to said clock means for determining when a vehicle has been present over said magnetometer for a predetermined period of time and thereafter increasing said clock frequency until said digital nulling circuits have cancelled said magnetic field signals, thereby causing said vehicle detection system to return to an active sensing mode.

6. The vehicle detection system of claim 3 wherein said encoder means comprises:

a dual edge detector having an input coupled to said nulling means for sensing the leading and trailing edges of said vehicle presence pulse;

counter means coupled to said dual edge detector;

control logic means coupled to said nulling means and said counter means for determining which multi-tone signal is generated in response to whether a pulse leading edge or a pulse trailing edge has been sensed;

a plurality of tone generators coupled to said control logic means for generating said multi-tone signals;

a summer having multiple inputs and an output wherein one of said inputs is coupled to each of said tone generators; and an amplifier having an inverting input coupled to said output of said summer and an output coupled to said transmitter means.

7. The vehicle detection system of claim 3 wherein said decoder means comprises:

a plurality of phase-locked-loop tone decoders coupled to an audio output of said receiver means, wherein each of said phase-locked-loop decoders is set to recognize one of said tones in said multi-tone signals;

a plurality of pulse width discriminators respectively coupled to said plurality of phase-locked-loop decoders;

a plurality of digital latches respectively coupled to said plurality of pulse width discriminators, for storing a valid tone reception while said phase-locked-loop decoders are locked on to a signal; and decoding logic means formed of a plurality of AND gates having inputs coupled to said digital latches and outputs coupled to a flip-flop circuit, and indicator means coupled to said flip-flop circuit, wherein said indicator means is activated when a leading edge multi-tone signal is detected and deactivated when a trailing edge multi-tone signal is detected.

8. The vehicle detection system of claim 4 wherein there is further provided;

an undervoltage sensor means coupled to said battery for generating an undervoltage signal whenever said battery voltage falls below a predetermined level, wherein said undervoltage signal is coupled to said encoder means to generate a third multi-tone signal.

9. The vehicle detection system of claim 8 wherein said encoder means comprises:

a dual edge detector having an input coupled to said threshold detector means for sensing the leading and trailing edges of said vehicle presence pulse;

counter means coupled to said dual edge detector;

control logic means coupled to said threshold detector means, said counter means, and said undervoltage sensor means for determining which unique two-tone signal is generated in response to whether a vehicle presence pulse leading edge, trailing edge, or an undervoltage signal is sensed;

three tone generators coupled to said control logic means for generating said two-tone signals:

a summer having three inputs and an output wherein one of said inputs is coupled to each of said tone generators; and an amplifier having an inverting input coupled to said output of said summer and an output coupled to said transmitter means.

10. The vehicle detection system of claim 9 wherein said decoder means comprises:

three phase-locked-loop tone decoders coupled to an audio output of said receiver means, wherein each of said phase-locked-loop decoders is set to recognize one of said tones in said two-tone signals;

three pulse width discriminators respectively coupled to said three phase-locked-loop decoders;

three digital latches respectively coupled to said three pulse width discriminators, for storing a valid tone reception while said corresponding phase-locked-loop decoders are locked on to a signal; and decoding logic means formed of:

three AND gates having inputs respectively coupled to said three digital latches and outputs coupled to a vehicle presence flip-flop circuit and to an undervoltage flip-flop circuit;

first indicator means coupled to said vehicle presence flip-flop circuit wherein said first indicator means is activated when a leading edge two-tone signal is detected and deactivated when a trailing edge two-tone signal is detected; and second indicator means coupled to said undervoltage flip-flop circuit wherein said second indicator means is activated when an undervoltage two-tone signal is detected.

11. The vehicle detection system of claim 10, further including:

presence timer means coupled to said clock means for determining when a vehicle has been present over said magnetometer for a predetermined period of time and thereafter increasing said clock frequency until said digital nulling circuits have cancelled said magnetic field signals, thereby causing said vehicle detection system to return to an active sensing mode.

12. The vehicle detection system of claim 5, wherein said encoder means comprises:

a dual edge detector having an input coupled to said nulling means for sensing the leading and trailing edges of said vehicle presence pulse;

counter means coupled to said dual edge detector;

control logic means coupled to said nulling means and said counter means for determining which multi-tone signal is generated in response to whether a pulse leading edge or a pulse trailing edge has been sensed;

a plurality of tone generators coupled to said control logic means for generating said multi-tone signals;

a summer having multiple inputs and an output wherein one of said inputs is coupled to each of said tone generators; and an amplifier having an inverting input coupled to said output of said summer and an output coupled to said transmitter means.

13. The vehicle detection system of claim 12 wherein said decoder comprises:

a plurality of phase-locked-loop tone decoders coupled to an audio output of said receiver means, wherein each of said phase-locked-loop decoders is set to recognize one of said tones in said multi-tone signals;

a plurality of pulse width discriminators respectively coupled to said plurality of phase locked loop decoders;

a plurality of digital latches respectively coupled to said plurality of pulse width discriminators, for storing a valid tone reception while said phase-locked-loop decoders are locked on to a signal and decoding logic means formed of a plurality of AND gates having inputs coupled to said digital latches and outputs coupled to a flip-flop circuit, and indicator means coupled to said flip-flop circuit, wherein said indicator means is activated when a leading edge multi-tone signal is detected and deactivated when a trailing edge multi-tone signal is detected.

14. The vehicle detection system of claims 6 or 7 wherein said nulling means comprises:

a pair of digital nulling circuits respectively coupled to receive said vertical and horizontal magnetic field signals; wherein each of said nulling circuits comprises:

an amplifier having inverting and non-inverting inputs and a output, wherein said non-inverting input is coupled to the respective magnetic field signal;

digital-to-analog converter means coupled to the output of said amplifier for generating an analog voltage proportional to said magnetic field signal, wherein said analog voltage is coupled to the inverting input of said amplifier, thereby nulling said amplifier output; and clock means coupled to said digital-to-analog converter means for enabling said converter means at predetermined time intervals, thereby allowing said digital nulling circuit to cancel said magnetic field signal for slow changes in the levels thereof;

threshold detector means coupled to each of said digital nulling circuits for generating a vehicle presence pulse whenever said magnetic field signals exceed a predetermined level, wherein the output of said threshold detector means is coupled to said encoder means.

15. The vehicle detection system of claim 3 wherein said radiating transmission line comprises:

a strip of conducting material spiraled about and affixed to the outer surface of said cylindrical housing, said antenna being configured to radiate at the frequency of said transmitter means; and a ground plane formed of a conducting material affixed to the inner surface of said housing.

* * * * *